US008303733B2

(12) United States Patent
Hamada et al.

(10) Patent No.: US 8,303,733 B2
(45) Date of Patent: Nov. 6, 2012

(54) FERRITE-AUSTENITE STAINLESS STEEL SHEET FOR STRUCTURAL COMPONENT EXCELLENT IN WORKABILITY AND IMPACT-ABSORBING PROPERTY AND METHOD FOR PRODUCING THE SAME

(75) Inventors: Junichi Hamada, Tokyo (JP); Haruhiko Kajimura, Tokyo (JP); Eiichiro Ishimaru, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 134 days.

(21) Appl. No.: 12/735,476

(22) PCT Filed: Jan. 22, 2009

(86) PCT No.: PCT/JP2009/050966

§ 371 (c)(1),
(2), (4) Date: Jul. 19, 2010

(87) PCT Pub. No.: WO2009/093652

PCT Pub. Date: Jul. 30, 2009

(65) Prior Publication Data

US 2010/0294402 A1 Nov. 25, 2010

(30) Foreign Application Priority Data

Jan. 22, 2008 (JP) ..... 2008-011984
Jan. 14, 2009 (JP) ..... 2009-006046

(51) Int. Cl.
*C22C 38/42* (2006.01)
*C21D 8/02* (2006.01)

(52) U.S. Cl. ..... 148/325; 148/327; 148/608; 148/610; 148/650; 148/651; 148/652

(58) Field of Classification Search ..... 148/325, 148/327, 608, 610, 650–652
See application file for complete search history.

(56) References Cited

U.S. PATENT DOCUMENTS 4,824,491 A 4/1989 Tanaka et al.
(Continued)

FOREIGN PATENT DOCUMENTS

CN 1914344 2/2007
(Continued)

OTHER PUBLICATIONS

International Search Report dated Apr. 14, 2009 issued in corresponding PCT Application No. PCT/JP2009/050966.

(Continued)

*Primary Examiner* — Deborah Yee
(74) *Attorney, Agent, or Firm* — Kenyon & Kenyon LLP

(57) ABSTRACT

This stainless steel sheet includes, in terms of mass %, C: 0.001 to 0.1%, N: 0.01 to 0.15%, Si: 0.01 to 2%, Mn: 0.1 to 10%, P: 0.05% or less, S: 0.01% or less, Ni: 0.5 to 5%, Cr: 10 to 25%, and Cu: 0.5 to 5%, with a remainder being Fe and unavoidable impurities, and contains a ferrite phase as a main phase and 10% or more of an austenite phase, wherein a work-hardening rate in a strain range of up to 30% is 1000 MPa or more which is measured by a static tensile testing and a difference between static and dynamic stresses which occur when 10% of deformation is caused is 150 MPa or more. This method for producing a stainless steel includes annealing a cold-rolled steel sheet under conditions where a holding temperature is set to be in a range of 950 to 1150° C. and a cooling rate until 400° C. is set to be in a range of 3° C./sec or higher.

18 Claims, 4 Drawing Sheets

U.S. PATENT DOCUMENTS 5,672,215 A 9/1997 Azuma et al.

FOREIGN PATENT DOCUMENTS

| | | | |
|---|---|---|---|
| JP | 57-35668 | | 2/1982 |
| JP | 362047462 A | * | 5/1987 |
| JP | 63-169331 | | 7/1988 |
| JP | 1-165750 | | 6/1989 |
| JP | 10-219407 | | 8/1998 |
| JP | 2002-020843 | | 1/2002 |
| JP | 2002-97555 | | 4/2002 |
| JP | 2006-200035 | * | 3/2006 |
| JP | 2006-169622 | | 6/2006 |
| JP | 2006-183129 | | 7/2006 |
| JP | 2008-163359 | | 7/2008 |
| KR | 1995-0013188 | | 10/1995 |
| KR | 10-2006-0127107 | | 11/2006 |
| WO | WO 96/18751 | | 6/1996 |

OTHER PUBLICATIONS

"The Final Report of Research Group on High-Speed Deformation of Steels for Automotive Use", The Iron and Steel Institute of Japan, Mar. 2001, pp. 10-17 (Abstract provided).

Chinese Office Action, dated Jan. 18, 2012, issued in corresponding Chinese Application No. 200980102633.0, and an English translation thereof.

Korean Office Action, dated Apr. 5, 2012, issued in corresponding Korean Application No. 10-2010-7015974, and an English translation thereof.

* cited by examiner

FERRITE-AUSTENITE STAINLESS STEEL SHEET FOR STRUCTURAL COMPONENT EXCELLENT IN WORKABILITY AND IMPACT-ABSORBING PROPERTY AND METHOD FOR PRODUCING THE SAME

This application is a national stage application of International Application No. PCT/JP2009/050966, filed 22 Jan. 2009, which claims priority to Japanese Application Nos. 2008-011984, filed 22 Jan. 2008; and 2009-006046, filed 14 Jan. 2009, each of which is incorporated by reference in its entirety.

TECHNICAL FIELD

The present invention relates to a stainless steel sheet which is used for structural components mainly requiring strength and impact absorption performance, and a method for producing the same. Specifically, the present invention relates to a stainless steel sheet for impact absorption components of automobile and bus such as front side members, pillars and bumpers, and for structural components such as vehicle suspension components, railcar bodies and bicycle rims, and a method for producing the same.

This application claims priority on Japanese Patent Application No. 2008-011984 filed on Jan. 22, 2008 and Japanese Patent Application No. 2009-6046 filed on Jan. 14, 2009, the contents of which are incorporated herein by reference.

BACKGROUND ART

In view of environmental concerns, improvements to the fuel efficiency of means of transport such as cars, motorcycles, buses, and railcars have recently be considered as a critical issue. One actively-pursued approach to boosting fuel efficiency has been a reduction in vehicle body weight. The reduction in vehicle body weight relies heavily on lowering the weight of the materials used to fabricate the body components, specifically on reducing the thickness of sheet steels. However, the reduction in sheet material thickness brings about deteriorations of rigidity and collision safety performance.

Because the strength enhancement of the materials which are used for the components is an effective way to increase the collision safety, high-strength steel sheets having compositions of mild steels are utilized in automobile impact absorption components. However, mild steels are poor in corrosion resistance; and therefore, multi-painting is essential for their use. They cannot be used for unpainted or lightly painted components, and the multi-painting inevitably increases costs. Cr-containing stainless steels are far superior to the mild steels in corrosion resistance. Therefore, the Cr-containing stainless steels are expected to have the potential to reduce weight by lowering the corrosion margin and to eliminate the need for painting.

Further, with regard to the collision safety improvement, in the case where a material having high impact absorption capability is utilized for a component such as a vehicle frame, the component collapses and deforms when the vehicle crashes; and thereby, it is possible to absorb the crash impact by the component collapse deformation. As a result, it is possible to lessen the impact on passengers during the collision. In other words, considerable merits can be realized regarding fuel economy improvement, reduction in vehicle body weight, simplification of painting and safety enhancement.

Austenite stainless steel sheets with high ductility, excellent formability, and excellent corrosion resistance such as SUS301L and SUS304 are generally used in vehicle components which are required to have corrosion resistance, for example structural components of railcars.

Patent Document 1 discloses an austenite stainless steel having excellent impact-absorbing capability at a high strain rate, which is intended for use mainly in structural components and reinforcing materials for railcars and ordinary vehicles. This stainless steel contains 6 to 8% of Ni and has an austenite microstructure. In the stainless steel, a work-induced martensite phase is generated during a deformation; and thereby, high strength is achieved during the high-speed deformation.

However, since a relatively large amount of Ni is contained, high cost is not avoided. Furthermore, stress corrosion cracking or aging cracking may occur depending on the chemical compositions or usage environment. Therefore, this austenite stainless steel has not been always adequate for use as a general-purpose structure.

Martensite stainless steel sheets which are imparted with high strength by quenching (for example, SUS420) do not contain Ni or contain Ni at a lower content than that contained in an austenite stainless steel; and therefore, the martensite stainless steel sheets are advantageous in terms of costs. However, the martensite stainless steel sheets have problems such as markedly low ductility and markedly poor toughness at a welded portion (weld toughness). Since there are large numbers of welded structures in automobiles, buses, and railcars, their structural reliability is greatly impaired by poor weld toughness.

Ferrite stainless steel sheets (for example, SUS430) are also advantageous in terms of costs as compared to the austenite stainless steels. However, since the ferrite stainless steel sheets have low strength, the ferrite stainless steel sheets are not suitable for components where strength is required. Furthermore, since the ferrite stainless steel sheets have low impact absorption energy during the high-speed deformation, it has been impossible to improve the collision safety performance. That is, particularly with regard to high-strength stainless steels containing a ferrite phase as the parent phase, because dynamic deformation properties in a high strain rate region at the time of vehicular crash are little understood, it has been difficult to apply the stainless steels to impact-absorbing components.

Further, the martensite stainless steels and the ferrite stainless steels exhibit markedly low formability in terms of elongation as compared to the austenite stainless steels. Therefore, even when a strength enhancement is achieved by means of solid-solution strengthening or precipitation strengthening (grain dispersion strengthening), there has been a major problem in that the stainless steels could not be formed into structural components.

On the other hand, in Patent Document 2 (not published at the time of filing the present application), the present inventors have disclosed a technique relating to a stainless steel for structural components with excellent impact-absorbing properties in which a Ni content is reduced and which contains a ferrite phase as the parent phase and 5% or more of a martensite phase as a main secondary phase. This is an invention similar to the present invention. However, since the secondary phase is mainly a martensite phase, a strain-induced plasticity does not occur. Therefore, the workability (elongation and work-hardening properties) is markedly low, and there has been a problem associated with component formability.

Further, Patent Documents 3 and 4 disclose techniques relating to austenite-ferrite stainless steels having excellent formability. In these techniques, a volume fraction of the austenite phase and a phase distribution of the austenite phase are adjusted so as to transform the austenite phase into a work-induced martensite phase during deformation, that is, to generate a so-called strain-induced plasticity. Thereby, a high ductility is attained. However, in the case where a steel material is applied for a structural component, work-hardening properties are important in the forming of the component, and a strength and an impact absorption performance are also important for the structural component. The techniques of Patent Documents 3 and 4 have not been sufficient for such requirements.

[Patent Document 1] Japanese Patent Application, Publication No. 2002-20843

[Patent Document 2] Japanese Patent Application No. 2006-350723

[Patent Document 3] Japanese Patent Application, Publication No. 2006-169622

[Patent Document 4] Japanese Patent Application, Publication No. 2006-183129

DISCLOSURE OF THE INVENTION

Problems to be Solved by the Invention

As discussed above, particularly with regard to a stainless steel sheet having a ferrite phase as the parent phase, there has been no technology which improves the impact absorption energy during a high-speed deformation for enhancing the strength to ensure a collision safety performance while ensuring the formability (especially elongation) to be processed into a component. To this end, the present invention aims to provide a stainless steel sheet which contains a ferrite phase as the parent phase and which has a high strength, excellent impact-absorbing properties during the high-speed deformation, and excellent formability, and a method for producing the same.

Means for Solving the Problems

In order to solve the above-mentioned problems, with regard to a stainless steel containing a ferrite phase as the parent phase, the present inventors have conducted metallographic studies on a deformation mechanism when subjected to a high-speed deformation and metallographic studies on an elongation when subjected to a low-speed tensile deformation. Then, a technique was found in which an enhancement of the strength, an improvement of the impact absorption energy during the high-speed deformation, and an improvement of the elongation during forming components can be achieved. In the technique, the above-described effects can be attained by forming an austenite phase as a secondary phase in the ferrite parent phase and inducing a martensitic transformation due to strains in the austenite phase during deformation.

Specifically, by adjusting element amounts in a composition of a steel which has a ferrite phase as the parent phase and includes Ni at a content lower than that of an ordinary austenite stainless steel, a duplex stainless steel is formed in which an austenite phase is metastable. Thereby, a strain-induced transformation in which the austenite phase transforms into a martensite phase during a deformation. Due to the strain-induced transformation, a work-hardening rate and a breaking elongation during a static deformation can be improved as compared to ferrite stainless steels. Further, by utilizing an increase in the strength and the work-hardening rate and the strain-induced transformation during the static deformation, a deformation resistance during a dynamic deformation is increased to enhance the impact absorption energy.

As a result, by using the steel of the present invention as a material particularly for vehicle structural components such as automobiles, buses, railcars, and bicycles, an impact at vehicular collision is absorbed, and on the other hand, a breakdown of a vehicle body is minimized. Therefore, the safety of passengers can be improved remarkably. Furthermore, the steel of the present invention can contribute to a reduction of costs as compared to the use of the austenite stainless steels.

The ferrite-austenite stainless steel sheet of the present invention for structural components excellent in workability and impact-absorbing properties contains, in terms of mass %, C: 0.001 to 0.1%, N: 0.01 to 0.15%, Si: 0.01 to 2%, Mn: 0.1 to 10%, P: 0.05% or less, S: 0.01% or less, Ni: 0.5 to 5%, Cr: 10 to 25%, and Cu: 0.5 to 5%, with a remainder being Fe and unavoidable impurities, and contains a ferrite phase as a main phase and 10% or more of an austenite phase, wherein a work-hardening rate in a strain range of up to 30% is 1000 MPa or more which is measured by a static tensile testing and a difference between static and dynamic stresses which occur when 10% of deformation is caused is 150 MPa or more.

With regard to the ferrite-austenite stainless steel sheet of the present invention for structural components excellent in workability and impact-absorbing properties, the ferrite-austenite stainless steel sheet may further include, in terms of mass %, one or more selected from the group consisting of Ti: 0.5% or less, Nb: 0.5% or less, and V: 0.5% or less.

The ferrite-austenite stainless steel sheet may further include, in terms of mass %, one or more selected from the group consisting of Mo: 2% or less, Al: 5% or less, and B: 0.0030% or less.

The ferrite-austenite stainless steel sheet may further include, in terms of mass %, either one or both of Ca: 0.01% or less and Mg: 0.01% or less.

A mean value of a yield point and a tensile strength which are measured by a static tensile testing may be 500 MPa or more, and a breaking elongation may be 40% or more.

The method for producing a ferrite-austenite stainless steel sheet of the present invention for structural components excellent in workability and impact-absorbing properties includes annealing a cold-rolled steel sheet which contains, in terms of mass %, C: 0.001 to 0.1%, N: 0.01 to 0.15%, Si: 0.01 to 2%, Mn: 0.1 to 10%, P: 0.05% or less, S: 0.01% or less, Ni: 0.5 to 5%, Cr: 10 to 25%, and Cu: 0.5 to 5%, with a remainder being Fe and unavoidable impurities, wherein, in the annealing of the cold-rolled steel sheet, a holding temperature is set to be in a range of 950 to 1150° C. and a cooling rate until 400° C. is set to be in a range of 3° C./sec or higher.

As used herein, the term "dynamic tensile testing" refers to a high-speed tensile test at a strain rate of $10^3$/sec which corresponds to a strain rate in a vehicular crash. The term "static tensile testing" refers to a conventional tensile test where a strain rate is set to be in a range of $10^{-3}$ to $10^{-2}$/sec. In addition, the term "difference between static and dynamic stresses" refers to a difference between a stress which occurs when 10% of a strain is caused in the dynamic tensile testing and a stress which occurs when 10% of a strain is caused in the static tensile testing.

Effects of the Invention

As can be seen clearly from the foregoing description, in the present invention, a strain-induced transformation of an austenite phase which is a secondary phase occurs, particularly even without the addition of a high content of Ni. As a result, the present invention can provide a ferrite-austenite stainless steel sheet having excellent impact-absorbing properties which are comparable to those of an austenite stainless steel. Further, the ferrite-austenite stainless steel sheet of the present invention also exhibits an excellent elongation in terms of workability. Therefore, in the case where the ferrite-austenite stainless steel sheet of the present invention is applied, as a high-strength (high impact-absorbing properties) and high-formability stainless steel, particularly to structural components associated with transportation, such as automobiles, buses, and railcars, the present invention can provides great social benefit such as environmental measures due to a weight reduction, and improvements of collision safety performance.

BEST MODE FOR CARRYING OUT THE INVENTION

Figure 1:
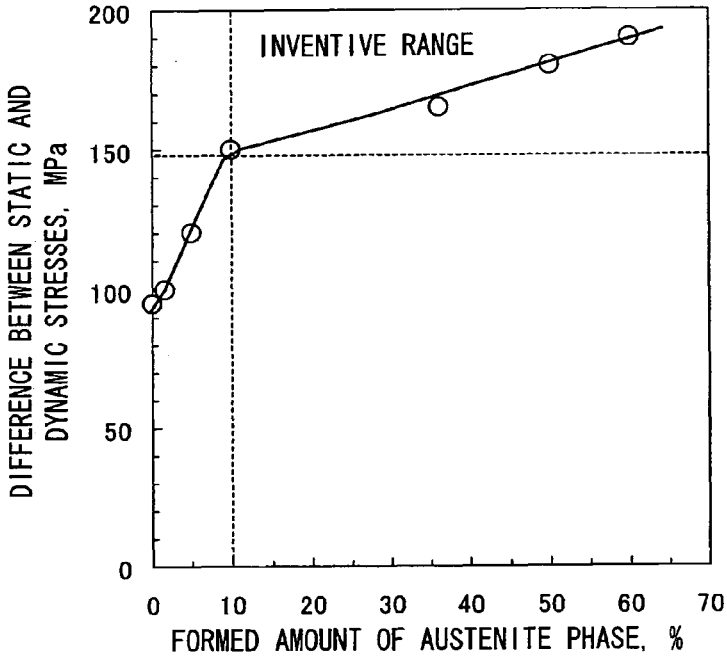
FIG. 1 is a view illustrating a relationship between a fraction of austenite phase and a difference between static and dynamic stresses.

Hereinafter, the present invention will be described in more detail.

First of all, the limiting conditions of a steel composition of the ferrite-austenite stainless steel sheet of the present invention will be described.

C is an element necessary to retain an austenite phase and to generate strain-induced transformation during a deformation. The content of C is set to be in a range of 0.001% or more. On the other hand, an excessive content of C leads to a deterioration of the formability and the corrosion resistance, and furthermore, a rigid martensite phase is formed; thereby, manufacturability becomes poor. Therefore, the upper limit of the C content is set to 0.1%. Further, in view of manufacturability and workability, the content of C is preferably in a range of 0.005 to 0.05%.

N is needed to retain an austenite phase and to generate strain-induced transformation during a deformation, and at the same time, N is effective for achieving high strength and improving corrosion resistance. Therefore, N is contained at a content of 0.01% or more. On the other hand, if the content of N exceeds 0.15%, the hot-rolling workability markedly deteriorates; and thereby, problems associated with manufacturability are caused. Therefore, the upper limit of the N content is set to 0.15%. Further, in view of the corrosion resistance and the manufacturability, the content of N is preferably in a range of 0.05 to 0.13%.

Si is a deoxidizing element and is also a solid-solution strengthening element which is effective for achieving high strength. Therefore, the content of Si is set to be in a range of 0.01% or more. On the other hand, if the content of Si exceeds 2%, the ductility markedly deteriorates. Therefore, the upper limit of the Si content is set to 2%. Further, in view of the corrosion resistance and the manufacturability, the content of Si is preferably in a range of 0.05 to 0.5%.

Mn is a deoxidizing element and is also a solid-solution strengthening element. furthermore, Mn increases a stability of the austenite phase at a low Ni content. Therefore, the content of Mn is set to be in a range of 0.1% or more. If the content of Mn exceeds 10%, the corrosion resistance deteriorates. Therefore, the upper limit of the Mn content is set to 10%. Further, in view of the manufacturability and costs, the content of Mn is preferably in a range of 1 to 6%.

P degrades the workability, the corrosion resistance, the manufacturability, and the like. Therefore, the lower the content of P, the better the properties, and the upper limit of the P content is set to 0.05%. On the other hand, refining costs increase in order to lower the P content; and therefore, the lower limit of the P content is preferably set to 0.01%. Further, in view of the workability, the content of P is preferably in a range of 0.01 to 0.03%.

S combines with Mn; and thereby, the corrosion resistance deteriorates. Therefore, the lower the content of S, the better the properties, and the upper limit of the S content is set to 0.01%. On the other hand, refining costs increase in order to lower the S content; and therefore, the lower limit of the S content is preferably set to 0.0001%. Further, in view of the production costs, the content of S is preferably in a range of 0.0005 to 0.009%.

Cr is added in terms of the corrosion resistance, and it is necessary to contain Cr at a content within a range of 10% or more in order to generate a strain-induced plasticity of an austenite phase. On the other hand, if the content of Cr exceeds 25%, the toughness is markedly lowered; and thereby, the manufacturability deteriorates and the impact properties at welded portions (weld impact properties) deteriorates. Accordingly, the content of Cr is set to be within a range of 10 to 25%. Further, in view of the production costs and the rust resistance, the content of Cr is preferably in a range of 13 to 23%.

Ni is an element which allows for an austenite phase to remain in a product (steel sheet). In view of the element costs, the upper limit of the Ni content is set to 5% in order to achieve a dual phase microstructure of a ferrite-austenite phase. If the content of Ni is less than 0.5%, the toughness is lowered and the corrosion resistance deteriorates. Therefore, the content of Ni is preferably in a range of 0.5 to 3%.

Cu, similar to Ni, is also an element which allows for an austenite phase to remain in a product (steel sheet). In view of the element costs, the upper limit of the Cu content is set to 5% in order to achieve a dual phase microstructure of a ferrite-austenite phase. If the content of Cu is less than 0.5%, the toughness is lowered and the corrosion resistance deteriorates. Therefore, the content of Cu is preferably in a range of 0.5 to 3%.

In the present invention, the above-mentioned elements are contained as basic components, and the elements which will be illustrated hereinafter may be optionally contained.

Ti, Nb, and V combine with C and N; and thereby, the formation of Cr carbonitrides is inhibited. As a result, intergranular corrosion at the welded portions is suppressed. Therefore, these elements are added if necessary. However, Ti, Nb, and V are ferrite-forming elements, and if an excessive amount thereof is contained, an austenite phase is not formed, and the ductility deteriorates. Therefore, the upper limit of each of the contents of Ti, Nb and V is set to 0.5%. In addition, if the content of each of Ti, Nb and V is less than 0.05%, the fixing of C and N may be insufficient; and therefore, the content of each of Ti, Nb, and V is preferably in a range of 0.05 to 0.3%.

Mo has an effect of improving the corrosion resistance, and Mo is also a solid-solution strengthening element. Mo may be appropriately added depending on the corrosion resistance level required in the usage environment. An excessive addition of Mo leads to poor workability and increased costs; and therefore, the upper limit of the Mo content is set to 2%. In addition, if the content of Mo is less than 0.3%, the corrosion resistance may deteriorate. Therefore, the content of Mo is preferably in a range of 0.3 to 1.8%.

Al is added as a deoxidizing element. Also, Al forms nitrides; and thereby, workability is improved. Furthermore, Al is an element which is effective for enhancing strength by solid-solution strengthening and is also effective for improving oxidation resistance. An excessive addition of Al leads to the occurrence of surface defects and a deterioration of the weldability. Therefore, the upper limit of the Al content is set to 5%. In addition, if the content of Al is less than 0.02%, a deoxidation time may be prolonged; and thereby, the productivity may be lowered. Therefore, the content of Al is preferably in a range of 0.02 to 1%.

B is an element effective for enhancing strength, and B is also an element inhibiting secondary work embrittlement. An excessive addition of B leads to a deterioration of the corrosion resistance at welded portions and increased costs. Therefore, the upper limit of the B content is set to 0.0030%. In addition, if the content of B is less than 0.0003%, the effect of inhibiting the secondary work embrittlement may be lessened. Therefore, the content of B is preferably in a range of 0.0003 to 0.0010%.

Ca may be added to fix S so as to improve the hot-rolling workability. Meanwhile, if the content of Ca exceeds 0.01%, this results in a deterioration of the corrosion resistance; and therefore, the upper limit of the Ca content is set to 0.01%. In addition, if the content of Ca is less than 0.0005%, the fixing of S may be insufficient. Therefore, the content of Ca is preferably in a range of 0.0005 to 0.001% in terms of manufacturability.

Mg may be added as a deoxidizing element. In addition, Mg contributes to an improvement of the manufacturability due to a refinement of ferrite grains, an improvement of the surface defects referred to as "ridging", and an improvement of the workability at welded portions. On the other hand, if the content of Mg exceeds 0.01%, the corrosion resistance deteriorates markedly; and therefore, the upper limit of the Mg content is set to 0.01%. In addition, if the content of Mg is less than 0.0003%, it may be insufficient to control the microstructure; and therefore, the content of Mg is set to 0.0003% or more. In view of the manufacturability, the content of Mg is preferably in a range of 0.0003 to 0.002%.

In the present invention, the point is an impact absorption energy when an impact is applied at a high impact velocity, together with the formability to be processed into components. Since the impact occurring upon a vehicle body crash is applied to structural components, an impact-absorbing capability of materials used to fabricate the components is important. Conventionally, there was no attempt to provide a high-strength stainless steel containing a ferrite phase as the parent phase, while considering the formability to be processed into the component, the impact absorption energy at a high strain rate, and an increase of the deformation stress. Consequently, no vehicle design has been made based on such an idea.

Most of structural components for vehicles have a square-shaped cross section represented by hot molded articles, and an absorption energy in such high-speed collapse deformation is absorbed in a strain range of up to 10% (Report on Research Group Results Regarding High-Speed Deformation of Automotive Materials" (compiled by The Iron and Steel Institute of Japan, March 2001, p12)). In addition, the strain rate during vehicular crash corresponds to an extremely high strain rate of $10^3$/sec.

On the basis of the above, as an evaluation of high-speed deformation properties, a tensile test at a strain rate of $10^3$/sec is carried out and is taken as a dynamic tensile testing. In this dynamic tensile testing, an absorption energy until 10% of a strain is caused is calculated from the stress and the strain. The amount (%) of strain until which the absorption energy will be taken as an index depends on the shape of components. And, it is considered that the absorption energy until 10% of the strain is caused is reasonable as an index for a steel sheet used in front side members of automobiles or the like, as described in the above-referenced "Report on Research Group Results Regarding High-Speed Deformation of Automotive Materials" (compiled by The Iron and Steel Institute of Japan, March 2001, p12".

In addition, a yield point is measured by the dynamic tensile testing and is taken as a dynamic yield point. On the other hand, a yield point is also measured by a conventional tensile test (at a strain rate of $10^{-3}$ to $10^{-2}$/sec) and is taken as a static yield point.

FIG. 1 illustrates the results of a difference between static and dynamic stresses when a fraction of an austenite phase was changed by altering the contents of Mn, Ni and N, for a steel containing 0.01% C-0.1% Si-0.03% P-0.002% S-21% Cr-0.5% Cu, together with existing steels [SUS430 (0.05% C-0.3% Si-0.5% Mn-0.03% P-0.005% S-16% Cr-0.1% Ni-0.03% Cu-0.03% N), SUS316 (0.05% C-0.5% Si-0.9% Mn-0.02% P-0.001% S-12.5% Ni-16.8% Cr-2.5% Mo-0.3% Cu-0.03% N), SUS301L (0.02% C-0.6% Si-1.1% Mn-0.03% P-0.001% S-7.1% Ni-17.5% Cr-0.2% Cu-0.13% N), and the like].

Here, the difference between static and dynamic stresses is an index marker representing a dependency of a work hardening on a deformation rate and refers to a difference between the stress value when 10% of a strain is caused in the dynamic tensile testing and the stress value when 10% of a strain is caused in the static tensile testing. That is, in the present invention, the difference between static and dynamic stresses is a value of (a stress which occurs when 10% of a strain is caused in the dynamic tensile testing at a strain rate of $10^3$/sec)−(a stress which occurs when 10% of a strain is caused in the static tensile testing at a strain rate of $10^{-3}$ to $10^{-2}$/sec).

Since the difference between static and dynamic stresses represents what degree of hardening occurs during a high-speed deformation such as a collision of automobiles, a larger value of the difference between static and dynamic stresses is preferable for a steel sheet used for impact-absorbing structural components.

If a fraction of an austenite phase is low, an amount of strain-induced transformation during deformation is decreased; and thereby, an increase in stress during a static deformation and a dynamic deformation becomes small. If the fraction of the austenite phase is less than 10%, the difference between static and dynamic stresses becomes less than 150 MPa. Accordingly, the proportion of the austenite phase in a product (steel sheet) is set to be in a range of 10% or more. On the contrary, in view of the ductility, the upper limit of the fraction of the austenite phase is preferably 90% or less.

Figure 2:
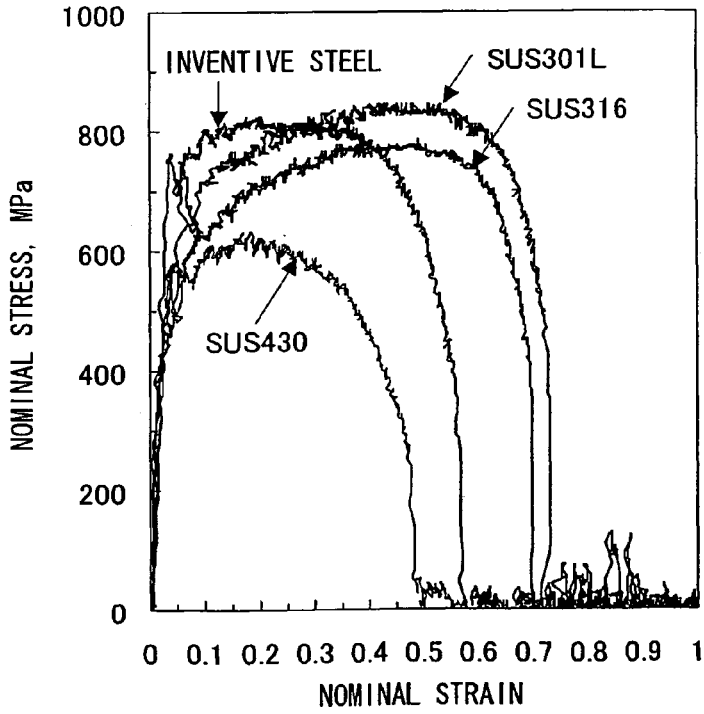
FIG. 2 is a view illustrating a stress-strain curve obtained by a dynamic tensile testing.

FIG. 2 illustrates a stress-strain curve measured by the dynamic tensile testing for the existing stainless steels and the inventive steel (0.01% C-0.1% Si-3% Mn-0.03% P-0.002% S-21% Cr-2% Ni-0.5% Cu-0.1% N). The results were obtained by a high-speed tensile testing at a strain rate of $10^3$/sec in the rolling direction, and all the existing stainless steels and the inventive steel were cold rolled-annealed steel sheets having a thickness of 1.5 mm (annealing conditions will be described hereinafter).

In the results of FIG. 2, a stress which occurs in the high-speed deformation is high in the austenite stainless steel, as compared to the ferrite stainless steel SUS430. Further, with regard to the austenite stainless steels, a stress is higher in SUS301L where strain-induced transformation occurs than that in SUS316 where strain-induced transformation does not readily occur. In this connection, the inventive steel has a higher stress in a low-strain range (up to about 30%) than that of SUS301L which exhibits the most excellent impact-absorbing properties among the existing steels; and therefore, the inventive steel has an extremely excellent impact absorption capability. Since a high stress leads to an increase in the impact absorption value, the steel sheet having a high stress is superior in impact-absorbing properties.

Tables 1 and 2 show the results of the static tensile testing and the dynamic tensile testing for the inventive steel and the existing steels (conventional steels). In the present invention, based on the difference between static and dynamic stresses of SUS301L, a difference between static and dynamic stresses at 10% of deformation (which occur when 10% of deformation is caused) is defined as 150 MPa or more. As shown in Tables 1 and 2, the present invention can provide a steel having a high strength and a high difference between static and dynamic stresses which could not be achieved by conventional steels where a strain-induced martensite phase is utilized. In addition, the upper limit of a difference between static and dynamic stresses at 10% deformation is not particularly determined, and a higher value thereof is preferable.

TABLE 1

| Steel | Parent phase | Proportion of secondary phase (austenite phase) (%) | Yield point (YP) in static tensile testing (MPa) | Tensile strength (TS) in static tensile testing (MPa) | (YP + TS)/2 (MPa) | Breaking elongation in static tensile testing (%) |
|---|---|---|---|---|---|---|
| Inventive steel | Ferrite | 45 | 442 | 724 | 583 | 45 |
| SUS301L | Austenite | — | 377 | 727 | 552 | 56 |
| SUS316 | Austenite | — | 306 | 622 | 464 | 37 |
| SUS430 | Ferrite | 0 | 342 | 480 | 411 | 30 |

TABLE 2

| Steel | Work-hardening rate in strain range of up to 30% in static tensile testing (MPa) | Stress when 10% of strain is caused in static tensile testing (MPa) | Stress when 10% of strain is caused in dynamic tensile testing (MPa) | Difference between static and dynamic stresses at 10% of deformation (MPa) | Absorption energy at 10% of deformation in dynamic tensile testing (MJ/m$^3$) | Amount of work-induced martensite after static tensile testing (%) |
|---|---|---|---|---|---|---|
| Inventive steel | 1150 | 624 | 800 | 176 | 65 | 10 |
| SUS301L | 1640 | 550 | 714 | 164 | 50 | 40 |
| SUS316 | 1120 | 500 | 627 | 127 | 46 | 0.3 |
| SUS430 | 0 | 473 | 569 | 96 | 45 | 0 |

Figure 3:
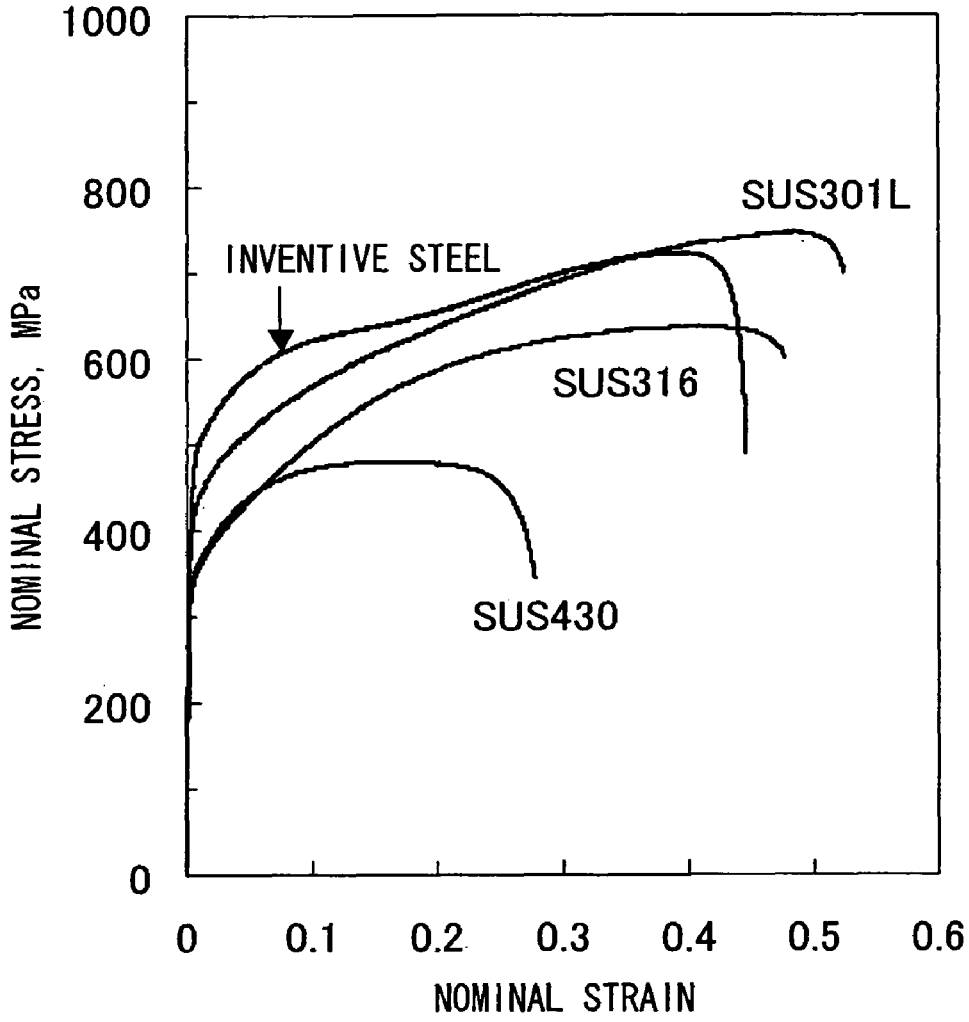
FIG. 3 is a view illustrating a stress-strain curve obtained by a static tensile testing.

FIG. 3 illustrates a stress-strain curve measured by a static tensile testing. Here, the static tensile testing was carried out in accordance with JIS Z2241. It can be seen that the inventive steel exhibits a breaking elongation of 40%, and has a high work-hardening rate as compared to the ferrite stainless steel SUS430.

Figure 4:
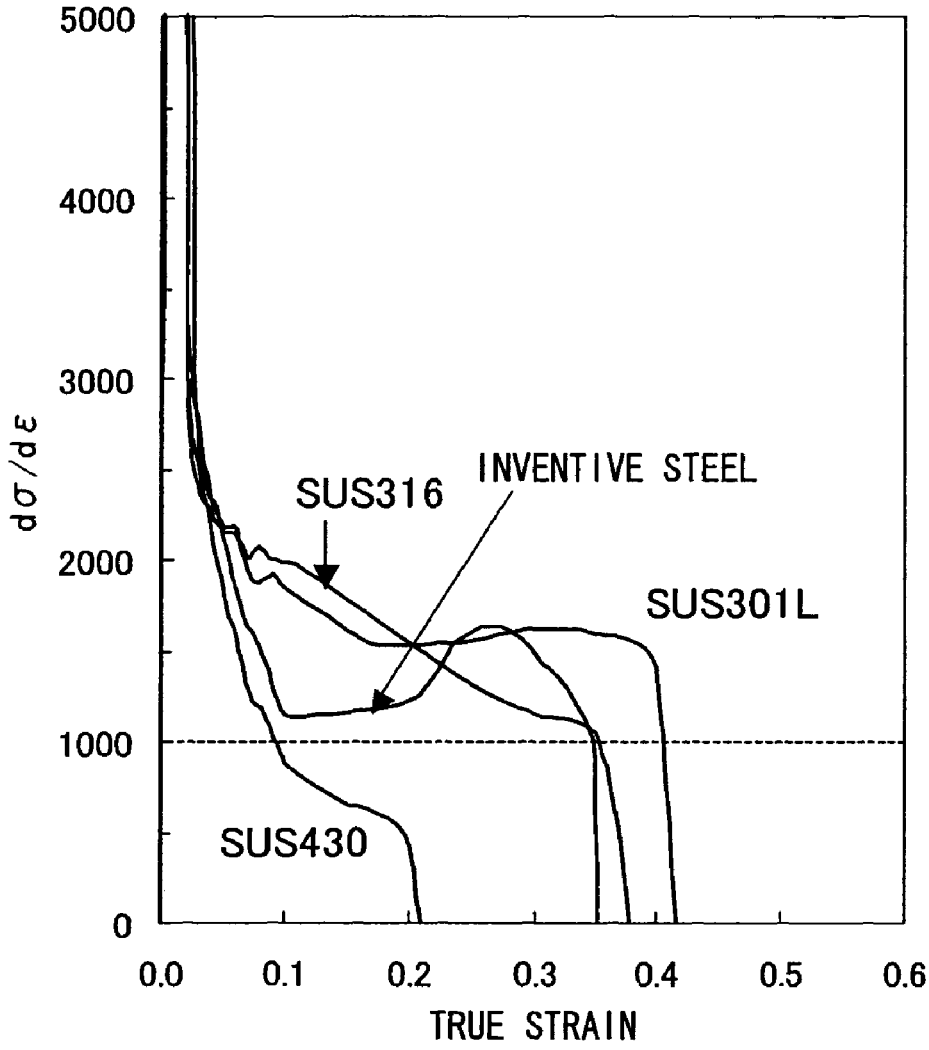
FIG. 4 is a view illustrating a relationship between a true strain and a work-hardening rate obtained by a static tensile testing.

FIG. 4 illustrates the relationship between the strain and the work-hardening rate. The abscissa axis represents a true strain ($\epsilon$), and $d\sigma/d\epsilon$ of the ordinate axis represents a change rate of the true stress. Since this change rate of the true stress corresponds to a work-hardening rate, the change rate of the true stress is preferably high for a steel sheet used for structural components. Based on the above, the inventive steel exhibits more excellent work-hardening properties than that of the ferrite stainless steel. Further, with regard to the inventive steel, the work-hardening rate increases in a high-strain range during a static deformation. From the results, it can be understood that an austenite phase undergoes work-induced transformation to generate strain-induced plasticity.

The work-hardening rate varies depending on the strain range in the static tensile testing; however, if the minimum value of the work-hardening rate in a strain range of 30% or less is 1000 MPa or more, the work-hardening properties are greatly improved, and these improved work-hardening properties are effective for the enhancement of strength during the high-speed deformation. From the results, in the present invention, the lower limit of the work-hardening rate in a strain range of up to 30% which is measured by the static tensile testing is set to 1000 MPa. A higher value thereof is preferred.

High strengthening in the yield point and the tensile strength is effective for improvements of impact-absorbing properties due to strength enhancement. However, a stress in a high-speed deformation may not be increased in the case where only the yield point is strengthened or in the case where only the tensile strength is strengthened. In order to increase the difference between static and dynamic stresses at 10% of strain, it is preferred to improve a stress which occurs in a plastic deformation process in whole.

In the present invention, a mean value of the yield point (YP) and the tensile strength (TS) which are measured by the static tensile testing is used as an index, instead of the stress which occurs in the plastic deformation. This mean value is preferably in a range of 500 MPa or more, and the higher the value, the better.

The inventive steel shown in Table 1 exhibits a high value of (YP+TS)/2 of 583 MPa.

Figure 5:
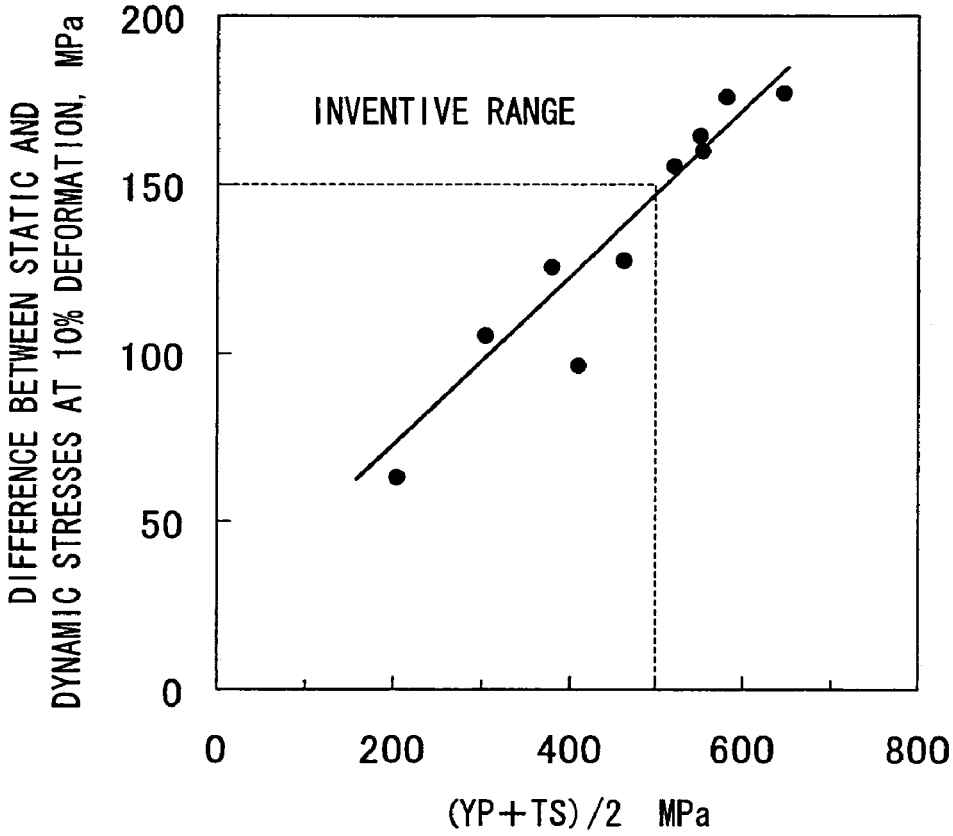
FIG. 5 is a view illustrating a relationship between a static tensile strength ((YS+TS)/2) and a difference between static and dynamic stresses.

FIG. 5 illustrates the relationship between the value of (YP+TS)/2 and the difference between static and dynamic stresses when a fraction of an austenite phase was changed by altering the contents of Mn, Ni and N, for a steel containing 0.01% C-0.1% Si-0.03% P-0.002% S-21% Cr-0.5% Cu, together with the existing steels (SUS430, SUS316, SUS301L, and the like).

In the case where the value of (YP+TS)/2 is 500 MPa or more, the difference between static and dynamic stresses becomes 150 MPa or more. Therefore, the value of (YP+TS)/2 measured by the static tensile testing is preferably set to 500 MPa or more.

Since the steel sheet of the present invention has a multi-phase microstructure where the parent phase is a ferrite phase and an austenite phase is formed as a secondary phase, the steel sheet exhibits a higher yield point than that of the ferrite stainless steel. Furthermore, when the steel sheet is processed into a component, the austenite phase transforms into a rigid martensite phase due to a strain-induced transformation; and thereby, the work-hardening rate increases markedly, and as a result, the tensile strength is improved. During the high-speed deformation, a strain-induced martensite phase is formed in a low-strain range; and thereby, the movement of dislocations is prevented, and as a result, the stress is increased. Since the steel sheet of the present invention has a dual phase microstructure of ferrite phase and austenite phase, and the strain-induced transformation occurs during a deformation, the steel sheet of the present invention can acquire a high strength and high impact-absorbing properties.

If an elongation during a static deformation is decreased due to the enhancement of strength, it becomes difficult to fabricate the steel sheet into structural components. As described above, in the steel sheet of the present invention, a strain-induced plasticity is generated due to a work-induced martensitic transformation during a deformation. Therefore, the steel sheet of the present invention has a high strength and excellent impact absorption performance together with a high breaking elongation during a static deformation. Although a vehicle body structure is variously complex, there is no problem in terms of work if the elongation (breaking elongation) is 40% or more. As previously shown in Table 2, in the inventive steel, a strain-induced martensite phase is formed at a volume fraction of 10% in the static tensile testing, and the inventive steel also has a high elongation of 45%.

Hereinafter, a method for producing the ferrite-austenite stainless steel sheet in accordance with the present invention will be described.

The method for producing the stainless steel sheet in accordance with the present invention includes a process of annealing a cold-rolled steel sheet.

The cold-rolled steel sheet has the same chemical composition as that of the above-mentioned stainless steel sheet of the present invention, and is prepared by a conventional process. For example, a steel having a desired chemical composition is melted and cast into a slab, and the slab is subjected to a hot rolling so as to obtain a hot-rolled steel sheet. Next, the hot-rolled steel sheet is subjected to an annealing and an acid pickling, and then is subjected to a cold rolling so as to prepare a cold-rolled steel sheet.

In the annealing process of the cold-rolled steel sheet, the cold-rolled steel sheet is heated and then is retained at a predetermined temperature (holding temperature). Thereafter, the cold-rolled steel sheet is cooled. In the present invention, the holding temperature is set to be in a range of 950 to 1150° C. During the cooling after the retention, the cooling rate until 400° C. is set to be in a range of 3° C./sec or higher. In view of the manufacturability and the shapes of the steel sheet, the upper limit of the cooling rate is preferably 50° C./sec.

It is sufficient to set the holding temperature in a range by which an austenite phase is formed at a fraction of 10% or more. However, if the holding temperature is less than 950° C., Cr carbonitrides and intermetallic compounds which are referred to as a σ phase precipitate; and thereby, the corrosion resistance and the toughness deteriorate. Therefore, the lower limit of the holding temperature is set to 950° C. On the other hand, if the holding temperature exceeds 1150° C., the fraction of the austenite phase becomes less than 10%, and the ferrite phase coarsens; and thereby, the formability and the toughness deteriorate. Therefore, the upper limit of the holding temperature is set to 1150° C.

During the cooling after the retention, if the cooling rate until 400° C. is less than 3° C./sec, the above-mentioned carbonitrides and intermetallic compounds are formed, and furthermore, elements such as carbon, nitrogen, and the like diffuse within the austenite phase. Thereby, the strain-induced transformation does not occur. As a result, excellent workability and impact absorption performance may not be obtained in some cases. Therefore, the cooling rate until 400° C. is set to be in a range of 3° C./sec or higher. In view of the manufacturability, the holding temperature is preferably in a range of 1000 to 1100° C., and the cooling rate until 400° C. is preferably in a range of 4° C./sec or higher.

In addition, with regard to the method for producing a stainless steel sheet of the present invention, production conditions of the cold-rolled steel sheet (hot-rolling conditions, the thickness of the hot-rolled steel sheet, an annealing atmosphere and annealing conditions of the hot-rolled steel sheet, and cold-rolling conditions) and an annealing atmosphere of the cold-rolled steel sheet may be appropriately adjusted. With regard to a pass schedule, a cold-rolling rate, and a roll diameter in the cold-rolling, existing facilities may be efficiently utilized without a need for special facilities.

Further, a temper rolling or a tension leveler may be applied after the cold-rolling and the annealing. In addition, the sheet thickness of a product (stainless steel sheet) may also be adjusted depending on the thickness of required components.

EXAMPLES

Hereinafter, the present invention will be described in more detail with reference to Examples.

A steel having a chemical composition shown in Tables 3 and 4 was melted and was cast into a slab. The resulting slab was subjected to a hot rolling to prepare a hot-rolled steel sheet. Next, the hot-rolled steel sheet was subjected to an annealing and an acid pickling, and then was subjected to a cold rolling to obtain a cold-rolled steel sheet having a thickness of 1.5 mm. The obtained cold-rolled steel sheet was annealed under the conditions given in Table 5, and then was subjected to an acid pickling to prepare a product steel sheet (stainless steel sheet).

The obtained product steel sheet was subjected to the above-mentioned static tensile testing and dynamic tensile testing.

Further, with regard to the metal microstructure, observation and evaluation were carried out as follows. The metal microstructure at or in the vicinity of the sheet thickness central layer was exposed by etching, and then the microstructure was observed by an optical microscope, and was photographed. Using an image analyzer, an area fraction of an austenite phase, which is a secondary phase of the metal microstructure in the picture, was measured and taken as a phase fraction (generation ratio) of the austenite phase.

The obtained results are given in Tables 5 to 8. In addition, the underlined values in Tables are values outside the specified range of the present invention.

TABLE 3

| | No. | C | N | Si | Mn | P | S | Cr | Ni | Cu | Ti | Nb | V | Mo | Al | B | Ca | Mg |
|---|---|---|---|---|---|---|---|---|---|---|---|---|---|---|---|---|---|---|
| Inventive Examples | 1 | 0.012 | 0.10 | 0.1 | 2.9 | 0.03 | 0.0020 | 20.9 | 2.1 | 0.5 | — | — | — | — | — | — | — | — |
| | 2 | 0.020 | 0.13 | 0.5 | 4.9 | 0.02 | 0.0052 | 19.5 | 0.6 | 0.6 | — | — | — | — | 0.02 | — | — | — |
| | 3 | 0.050 | 0.15 | 0.2 | 2.5 | 0.03 | 0.0083 | 20.3 | 0.6 | 0.5 | — | — | — | — | — | — | — | — |
| | 4 | 0.025 | 0.12 | 1.8 | 5.0 | 0.03 | 0.0010 | 17.2 | 0.8 | 0.5 | — | — | — | — | — | — | — | — |
| | 5 | 0.015 | 0.11 | 0.2 | 3.3 | 0.03 | 0.0032 | 20.5 | 1.9 | 0.7 | 0.06 | — | — | — | — | — | — | — |
| | 6 | 0.020 | 0.13 | 1.8 | 3.5 | 0.02 | 0.0041 | 13.5 | 0.8 | 0.5 | 0.2 | 0.3 | 0.05 | — | 0.10 | 0.0005 | — | — |
| | 7 | 0.050 | 0.04 | 0.3 | 5.8 | 0.01 | 0.0009 | 11.2 | 0.9 | 0.7 | — | 0.3 | 0.05 | — | 1.2 | — | — | — |
| | 8 | 0.020 | 0.15 | 0.9 | 4.6 | 0.02 | 0.0046 | 13.2 | 0.6 | 0.6 | 0.1 | 0.3 | 0.01 | — | 0.9 | — | — | — |
| | 9 | 0.010 | 0.10 | 0.1 | 2.9 | 0.03 | 0.0023 | 20.9 | 2.1 | 0.5 | — | — | — | — | 0.02 | 0.0008 | — | — |
| | 10 | 0.010 | 0.14 | 0.1 | 3.0 | 0.03 | 0.0034 | 20.5 | 1.9 | 0.6 | — | — | 0.08 | 0.35 | 0.02 | 0.0008 | 0.0010 | — |
| | 11 | 0.015 | 0.13 | 0.2 | 3.1 | 0.03 | 0.0023 | 20.5 | 1.9 | 0.6 | — | — | | — | 0.03 | — | 0.0009 | — |
| | 12 | 0.025 | 0.09 | 0.6 | 5.5 | 0.01 | 0.0036 | 18.8 | 1.1 | 0.4 | 0.09 | — | — | — | 0.02 | — | — | 0.0010 |
| | 13 | 0.020 | 0.09 | 0.2 | 4.2 | 0.02 | 0.0010 | 20.5 | 1.0 | 1.4 | — | — | 0.05 | 1.20 | 0.03 | 0.0005 | 0.0008 | 0.0009 |
| Comparative Examples | 14 | 0.020 | 0.11 | 0.5 | 1.0 | 0.03 | 0.0025 | 17.3 | 7.4 | 0.2 | — | — | 0.08 | 0.18 | — | — | — | — |
| | 15 | 0.055 | 0.04 | 0.4 | 1.1 | 0.02 | 0.0051 | 18.1 | 8.1 | 0.1 | — | — | 0.05 | 0.12 | 0.02 | — | — | — |
| | 16 | 0.048 | 0.03 | 0.5 | 0.9 | 0.02 | 0.0010 | 16.8 | 12.5 | 0.3 | — | — | 0.05 | 2.6 | 0.01 | — | — | — |

TABLE 4

| | No. | C | N | Si | Mn | P | S | Cr | Ni | Cu | Ti | Nb | V | Mo | Al | B | Ca | Mg |
|---|---|---|---|---|---|---|---|---|---|---|---|---|---|---|---|---|---|---|
| Comparative Examples | 17 | 0.057 | 0.03 | 0.5 | 0.2 | 0.02 | 0.0050 | 16.2 | 0.1 | 0.01 | — | — | 0.10 | — | 0.03 | — | — | — |
| | 18 | 0.150 | 0.10 | 0.2 | 2.5 | 0.03 | 0.0025 | 19.9 | 2.5 | 0.6 | — | — | — | — | 0.05 | | | |
| | 19 | 0.006 | 0.009 | 0.1 | 0.1 | 0.03 | 0.0010 | 18.0 | 3.0 | 0.5 | 0.2 | — | 0.05 | — | 0.03 | — | — | — |
| | 20 | 0.015 | 0.15 | 1.3 | 3.5 | 0.03 | 0.0035 | 21.5 | 1.2 | 0.5 | — | — | — | — | 0.05 | — | — | |
| | 21 | 0.020 | 0.15 | 0.5 | 0.05 | 0.03 | 0.0063 | 20.4 | 0.6 | 0.5 | — | — | — | — | 0.05 | — | — | — |
| | 22 | 0.030 | 0.15 | 0.6 | 1.5 | 0.03 | 0.0064 | 30.0 | 1.9 | 0.7 | — | — | — | — | 0.05 | — | — | — |
| | 23 | 0.029 | 0.11 | 0.5 | 5.5 | 0.03 | 0.0035 | 9.5 | 3.5 | 0.6 | — | — | — | — | 0.07 | — | — | — |
| | 24 | 0.040 | 0.15 | 0.5 | 4.3 | 0.04 | 0.0050 | 23.0 | 1.5 | 0.2 | — | — | — | — | 0.06 | — | — | — |
| | 25 | 0.020 | 0.11 | 0.9 | 4.6 | 0.02 | 0.0046 | 13.2 | 0.6 | 0.6 | 0.8 | 0.3 | 0.10 | — | 0.02 | — | — | — |
| | 26 | 0.034 | 0.14 | 0.5 | 5.2 | 0.02 | 0.0033 | 16.5 | 0.5 | 0.5 | — | 0.8 | 0.09 | — | 0.06 | — | — | — |
| | 27 | 0.042 | 0.09 | 0.6 | 4.4 | 0.04 | 0.0052 | 18.3 | 0.6 | 0.8 | — | — | 1.2 | — | 0.13 | — | — | — |
| | 28 | 0.016 | 0.13 | 0.2 | 3.5 | 0.03 | 0.0020 | 21.3 | 2.5 | 0.6 | — | — | 0.0 | 2.5 | 0.09 | — | — | — |
| | 29 | 0.019 | 0.09 | 0.3 | 3.4 | 0.03 | 0.0020 | 21.9 | 2.8 | 0.5 | — | — | — | — | 7.5 | — | — | — |
| | 30 | 0.023 | 0.15 | 0.5 | 4.6 | 0.04 | 0.0046 | 20.5 | 3.3 | 0.7 | — | — | — | — | 0.02 | 0.0053 | — | — |
| | 31 | 0.012 | 0.10 | 0.1 | 2.9 | 0.03 | 0.0020 | 20.9 | 2.1 | 0.5 | — | — | — | — | 0.02 | — | — | — |
| | 32 | 0.012 | 0.10 | 0.1 | 2.9 | 0.03 | 0.0020 | 20.9 | 2.1 | 0.5 | — | — | — | — | 0.02 | — | — | — |

TABLE 5

| | No. | Holding temperature in annealing of cold-rolled steel sheet (° C.) | Cooling rate in annealing of cold-rolled steel sheet (° C./sec) | Fraction of austenite phase (%) |
|---|---|---|---|---|
| Inventive Examples | 1 | 1050 | 7 | 45 |
| | 2 | 1080 | 5 | 40 |
| | 3 | 1040 | 10 | 58 |
| | 4 | 1060 | 8 | 62 |
| | 5 | 1050 | 6 | 42 |
| | 6 | 1000 | 15 | 15 |
| | 7 | 950 | 6 | 19 |
| | 8 | 980 | 9 | 38 |
| | 9 | 1080 | 11 | 25 |
| | 10 | 1050 | 19 | 55 |
| | 11 | 1050 | 10 | 44 |
| | 12 | 1050 | 10 | 35 |
| | 13 | 1100 | 9 | 34 |
| Comparative Examples | 14 | 1080 | 10 | 100 |
| | 15 | 1080 | 15 | 100 |
| | 16 | 1080 | 8 | 100 |
| | 17 | 830 | 5 | 0 |
| | 18 | 1075 | 6 | 86 |
| | 19 | 1100 | 7 | 0 |
| | 20 | 1050 | 6 | 16 |
| | 21 | 1050 | 9 | 7 |
| | 22 | 1080 | 6 | 5 |
| | 23 | 980 | 13 | 2 |
| | 24 | 1050 | 7 | 60 |
| | 25 | 1050 | 10 | 3 |
| | 26 | 1100 | 6 | 83 |

TABLE 5-continued

| | No. | Holding temperature in annealing of cold-rolled steel sheet (° C.) | Cooling rate in annealing of cold-rolled steel sheet (° C./sec) | Fraction of austenite phase (%) |
|---|---|---|---|---|
| | 27 | 1100 | 6 | 75 |
| | 28 | 1100 | 5 | 50 |
| | 29 | 1150 | 15 | 3 |
| | 30 | 1050 | 13 | 7 |
| | 31 | 1200 | 7 | 5 |
| | 32 | 1050 | 1 | 43 |

TABLE 6

| | No. | Yield point (YP) in static tensile testing (MPa) | Tensile strength (TS) in static tensile testing (MPa) | (YP + TS)/2 in static tensile testing (MPa) |
|---|---|---|---|---|
| Inventive Examples | 1 | 442 | 724 | 583 |
| | 2 | 530 | 650 | 590 |
| | 3 | 364 | 802 | 583 |
| | 4 | 395 | 721 | 558 |
| | 5 | 440 | 715 | 578 |
| | 6 | 415 | 638 | 527 |
| | 7 | 381 | 625 | 503 |
| | 8 | 415 | 595 | 505 |
| | 9 | 435 | 752 | 594 |
| | 10 | 469 | 795 | 632 |

TABLE 6-continued

| | No. | Yield point (YP) in static tensile testing (MPa) | Tensile strength (TS) in static tensile testing (MPa) | (YP + TS)/2 in static tensile testing (MPa) |
|---|---|---|---|---|
| | 11 | 462 | 736 | 599 |
| | 12 | 553 | 665 | 609 |
| | 13 | 596 | 873 | 735 |
| Comparative Examples | 14 | 377 | 727 | 552 |
| | 15 | 301 | 682 | 492 |
| | 16 | 306 | 622 | 464 |
| | 17 | 342 | 480 | 411 |
| | 18 | 686 | 735 | 711 |
| | 19 | 434 | 732 | 583 |
| | 20 | 560 | 705 | 633 |
| | 21 | 380 | 516 | 448 |
| | 22 | 402 | 533 | 468 |
| | 23 | 606 | 705 | 656 |
| | 24 | 550 | 630 | 590 |
| | 25 | 392 | 468 | 430 |
| | 26 | 465 | 695 | 580 |
| | 27 | 436 | 642 | 539 |
| | 28 | 492 | 775 | 634 |
| | 29 | 405 | 506 | 456 |
| | 30 | 405 | 571 | 488 |
| | 31 | 365 | 613 | 489 |
| | 32 | 345 | 586 | 466 |

TABLE 7

| | No. | Work-hardening rate in a strain range of up to 30% in static tensile testing (MPa) | Breaking elongation in static tensile testing (%) |
|---|---|---|---|
| Inventive Examples | 1 | 1150 | 45 |
| | 2 | 1090 | 54 |
| | 3 | 1170 | 56 |
| | 4 | 1530 | 50 |
| | 5 | 1125 | 44 |
| | 6 | 1020 | 44 |
| | 7 | 1060 | 53 |
| | 8 | 1110 | 46 |
| | 9 | 1090 | 43 |
| | 10 | 1190 | 42 |
| | 11 | 1120 | 46 |
| | 12 | 1095 | 51 |
| | 13 | 1130 | 40 |
| Comparative Examples | 14 | 1640 | 56 |
| | 15 | 1305 | 51 |
| | 16 | 1120 | 37 |
| | 17 | 0 | 30 |
| | 18 | 0 | 15 |
| | 19 | 0 | 20 |
| | 20 | 900 | 38 |
| | 21 | 0 | 33 |
| | 22 | 0 | 29 |
| | 23 | 0 | 5 |
| | 24 | 950 | 40 |
| | 25 | 0 | 28 |
| | 26 | 820 | 39 |
| | 27 | 730 | 38 |
| | 28 | 0 | 30 |
| | 29 | 0 | 15 |
| | 30 | 0 | 32 |
| | 31 | 0 | 35 |
| | 32 | 980 | 43 |

TABLE 8

| | No. | Stress when 10% of strain is caused in static tensile testing (MPa) | Stress when 10% of strain is caused in dynamic tensile testing (MPa) | Difference between static and dynamic stresses at 10% of deformation (MPa) |
|---|---|---|---|---|
| Inventive Examples | 1 | 624 | 800 | 176 |
| | 2 | 595 | 753 | 158 |
| | 3 | 516 | 702 | 186 |
| | 4 | 510 | 713 | 203 |
| | 5 | 633 | 815 | 182 |
| | 6 | 496 | 652 | 156 |
| | 7 | 573 | 795 | 222 |
| | 8 | 453 | 650 | 197 |
| | 9 | 589 | 792 | 203 |
| | 10 | 635 | 806 | 171 |
| | 11 | 635 | 796 | 161 |
| | 12 | 586 | 741 | 155 |
| | 13 | 606 | 765 | 159 |
| Comparative Examples | 14 | 550 | 714 | 164 |
| | 15 | 500 | 575 | 75 |
| | 16 | 500 | 627 | 127 |
| | 17 | 473 | 569 | 96 |
| | 18 | 753 | 796 | 43 |
| | 19 | 588 | 690 | 102 |
| | 20 | 593 | 688 | 95 |
| | 21 | 450 | 508 | 58 |
| | 22 | 506 | 634 | 128 |
| | 23 | 635 | 746 | 111 |
| | 24 | 689 | 793 | 104 |
| | 25 | 503 | 605 | 102 |
| | 26 | 634 | 772 | 138 |
| | 27 | 652 | 795 | 143 |
| | 28 | 673 | 850 | 177 |
| | 29 | 506 | 598 | 92 |
| | 30 | 605 | 715 | 110 |
| | 31 | 598 | 715 | 117 |
| | 32 | 616 | 753 | 137 |

As can be seen clearly from Tables 6 to 8, the inventive steels exhibit a high mean value of the yield point and the tensile strength which is 500 MPa or more in the static tensile testing, a difference between static and dynamic stresses of 150 MPa or more; and therefore, the inventive steels have excellent impact-absorbing properties. Further, the inventive steels exhibit a breaking elongation of 40% or more in the static tensile testing; and therefore, the inventive steels have excellent ductility. Further, the inventive steels exhibit a work-hardening rate of 1000 MPa or more in a true strain range of up to 30%; and therefore, the inventive steels have excellent work-hardening properties.

On the other hand, with regard to the comparative steels, Steel No. 14 which is SUS301L is excellent in workability and impact-absorbing properties; however, Steel No. 14 includes a high content of Ni; and thereby, the production costs and the steel costs increase.

Steel No. 15 is SUS304 and Steel No. 16 is SUS316. They are expensive because they include a high content of Ni. Furthermore, they exhibit a low difference between static and dynamic stresses at 10% of deformation.

Steel No. 17 is SUS430, and the contents of Ni and Cu are outside the specified ranges; and thereby, an austenite phase is not generated. Accordingly, the elongation and the difference between static and dynamic stresses are markedly low.

Steel No. 18 is a high-strength steel material because the content of C is more than the upper limit. However, Steel No. 18 exhibits a low elongation and a low work-hardening rate, and also exhibits a low difference between static and dynamic stresses.

Steel Nos. 19, 23, 25 and 29 have a fraction of austenite phase of less than 10%, and exhibits a low elongation and a low difference between static and dynamic stresses, because the contents of elements are outside the inventive range.

Steel Nos. 18, 20, and 21 exhibit markedly low elongations and low work-hardening rates, because the content of each of C, Si and Cr is more than the upper limit.

Steel No. 21 exhibit a markedly low elongation and a low work-hardening rate, because the content of Mn is lower than the lower limit.

Steel No. 24 exhibits a low difference between static and dynamic stresses, because the content of Cu is lower than the lower limit; and thereby, an increase in strength is lowered during a high-speed deformation.

Steel Nos. 26, 27, 28, and 30 exhibit low elongations and low differences between static and dynamic stresses, because an excess amount of each of Nb, V, Mo, and B is added.

In Steel Nos. 31, and 32, the contents of elements are within the inventive ranges; however, the annealing temperatures of the cold-rolled steel sheet and the cooling rates are outside the inventive range, and thereby, the strength is lowered. As a result, Steel Nos. 31, and 32 exhibit low differences between static and dynamic stresses.

INDUSTRIAL APPLICABILITY

The present invention can provide a ferrite-austenite stainless steel sheet having excellent impact-absorbing properties comparable to those of austenite stainless steels. Further, the steel sheet of the present invention exhibits an excellent elongation in terms of workability and excellent work-hardening properties. Therefore, the present invention can be applied, as a stainless steel with high strength (high impact-absorbing properties) and high formability, to structural components associated with transportation such as, particularly, automobiles, buses, railcars and the like, and the present invention can contribute to weight reduction, improvements of collision safety, and the like.

The invention claimed is:

1. A ferrite-austenite stainless steel sheet for structural components excellent in workability and impact-absorbing properties, comprising, in terms of mass %, C: 0.001 to 0.1%,
N: 0.01 to 0.15%,
Si: 0.01 to 0.5%,
Mn: 0.1 to 10%,
P: 0.05% or less,
S: 0.01% or less,
Ni: 0.5 to 5%,
Cr: 10 to 25%,
Cu: 0.5 to 5%, and
a balance of Fe and unavoidable impurities, the ferrite-austenite stainless steel containing a ferrite phase as a main phase and 10% or more of an austenite phase, wherein a work-hardening rate in a strain range of up to 30% is 1000MPa or more, when measured by a static tensile testing, and a difference between static and dynamic stresses which occurs when 10% of deformation is caused is 150MPa or more.

2. The ferrite-austenite stainless steel sheet for structural components excellent in workability and impact-absorbing properties according to claim 1, wherein the steel sheet further comprises, in terms of mass %, one or more elements selected from the group consisting of Ti: 0.5% or less, Nb: 0.5% or less, and V: 0.5% or less.

3. The ferrite-austenite stainless steel sheet for structural components excellent in workability and impact-absorbing properties according to claim 1, wherein the steel sheet further comprises, in terms of mass %, one or more elements selected from the group consisting of Mo: 2% or less, Al: 5% or less, and B: 0.0030% or less.

4. The ferrite-austenite stainless steel sheet for structural components excellent in workability and impact-absorbing properties according to claim 1, wherein the steel sheet further comprises, in terms of mass %, either one or both of Ca: 0.01% or less and Mg: 0.01% or less.

5. The ferrite-austenite stainless steel sheet for structural components excellent in workability and impact-absorbing properties according to claim 1, wherein a mean value of a yield point and a tensile strength which are measured by a static tensile testing is 500 MPa or more, and a breaking elongation is 40% or more.

6. A method for producing the ferrite-austenite stainless steel sheet for structural components excellent in workability and impact-absorbing properties, the method comprising annealing a cold-rolled steel sheet which contains, in terms of mass %, C: 0.001 to 0.1%, N: 0.01 to 0.15%, Si: 0.01 to 0.5%, Mn: 0.1 to 10%, P: 0.05% or less, S: 0.01% or less, Ni: 0.5 to 5%, Cr: 10 to 25%, Cu: 0.5 to 5%, and a balance of Fe and unavoidable impurities, wherein, in the annealing of the cold-rolled steel sheet, a holding temperature is set to be in a range of 950 to 1150° C. and a cooling rate until 400° C. is set to be in a range of 3° C/sec to 50° C/sec, wherein the ferrite-austenite stainless steel contains a ferrite phase as a main phase and 10% or more of an austenite phase, and wherein a work-hardening rate in a strain range of up to 30% is 1000MPa or more when measured by a static tensile testing and a difference between static and dynamic stresses which occurs when 10% of deformation is caused is 150MPa or more.

7. The method according to claim 6, wherein the steel sheet further comprises, in terms of mass %, one or more elements selected from the group consisting of Ti: 0.5% or less, Nb: 0.5% or less, and V: 0.5% or less.

8. The method according to claim 6, wherein the steel sheet further comprises, in terms of mass %, one or more elements selected from the group consisting of Mo: 2% or less, Al: 5% or less, and B: 0.0030% or less.

9. The method according to claim 7, wherein the steel sheet further comprises, in terms of mass %, one or more elements selected from the group consisting of Mo: 2% or less, Al: 5% or less, and B: 0.0030% or less.

10. The method according to claim 6, wherein the steel sheet further comprises, in terms of mass %, either one or both of Ca: 0.01% or less and Mg: 0.01% or less.

11. The method according to claim 7, wherein the steel sheet further comprises, in terms of mass %, either one or both of Ca: 0.01% or less and Mg: 0.01% or less.

12. The method according to claim 9, wherein the steel sheet further comprises, in terms of mass %, either one or both of Ca: 0.01% or less and Mg: 0.01% or less.

13. The ferrite-austenite stainless steel sheet for structural components excellent in workability and impact-absorbing properties according to claim 2, wherein the steel sheet further comprises, in terms of mass %, one or more elements selected from the group consisting of Mo: 2% or less, Al: 5% or less, and B: 0.0030% or less.

14. The ferrite-austenite stainless steel sheet for structural components excellent in workability and impact-absorbing properties according to claim 2, wherein the steel sheet further comprises, in terms of mass %, either one or both of Ca: 0.01% or less and Mg: 0.01% or less.

15. The ferrite-austenite stainless steel sheet for structural components excellent in workability and impact-absorbing properties according to claim 3, wherein the steel sheet further comprises, in terms of mass %, either one or both of Ca: 0.01% or less and Mg: 0.01% or less.

16. The ferrite-austenite stainless steel sheet for structural components excellent in workability and impact-absorbing properties according to claim 2, wherein a mean value of a yield point and a tensile strength which are measured by a static tensile testing is 500 MPa or more, and a breaking elongation is 40% or more.

17. The ferrite-austenite stainless steel sheet for structural components excellent in workability and impact-absorbing properties according to claim 3, wherein a mean value of a yield point and a tensile strength which are measured by a static tensile testing is 500 MPa or more, and a breaking elongation is 40% or more.

18. The ferrite-austenite stainless steel sheet for structural components excellent in workability and impact-absorbing properties according to claim 4, wherein a mean value of a yield point and a tensile strength which are measured by a static tensile testing is 500 MPa or more, and a breaking elongation is 40% or more.

* * * * *